US008771037B2

(12) United States Patent
Boggs et al.

(10) Patent No.: US 8,771,037 B2
(45) Date of Patent: Jul. 8, 2014

(54) PATTERN SANDER DEVICE, SYSTEM AND METHOD

(75) Inventors: Robert Bryan Boggs, Greenville, SC (US); Joseph Shannon Miller, Boiling Springs, SC (US); Michael Scott Standridge, Greer, SC (US); Jason Richard Shaw, Taylors, SC (US)

(73) Assignee: Columbia Insurance Company, Omaha, NE (US)

( * ) Notice: Subject to any disclaimer, the term of this patent is extended or adjusted under 35 U.S.C. 154(b) by 246 days.

(21) Appl. No.: 13/476,654

(22) Filed: May 21, 2012

(65) Prior Publication Data

US 2012/0295522 A1 Nov. 22, 2012

Related U.S. Application Data

(60) Provisional application No. 61/488,436, filed on May 20, 2011.

(51) Int. Cl.

| | |
|---|---|
| ***B24B 1/00*** | (2006.01) |
| ***B24B 21/00*** | (2006.01) |
| ***B24B 21/08*** | (2006.01) |
| ***B24D 11/04*** | (2006.01) |

(52) U.S. Cl.

CPC ..... *B24B 21/006* (2013.01); *B24B 21/08* (2013.01); *B24D 11/04* (2013.01)

USPC ..... 451/5; 451/303; 451/309; 451/299; 451/59; 451/11

(58) Field of Classification Search

CPC ..... B24B 21/08; B24B 21/12; B24B 49/00; B65G 43/00; B65G 43/04

USPC ..... 451/303, 309, 299, 59, 5, 11; 198/810.01–810.04, 571–573, 502.4, 198/460

See application file for complete search history.

(56) References Cited

U.S. PATENT DOCUMENTS

| | | | | |
|---|---|---|---|---|
| 2,904,937 | A * | 9/1959 | Feurich | 451/303 |
| 3,214,870 | A | 11/1965 | Elmendorf | |
| 3,570,190 | A * | 3/1971 | Rutt et al. | 451/303 |
| 4,084,356 | A * | 4/1978 | Brears | 451/59 |
| 4,512,110 | A * | 4/1985 | Stump | 451/303 |
| 4,676,029 | A * | 6/1987 | Palmer | 451/5 |

(Continued)

FOREIGN PATENT DOCUMENTS

FR 2428500 A3 1/1980

OTHER PUBLICATIONS

International Search Report and Written Opinion for International Application No. PCT/US2012/038843 (mailed Aug. 7, 2012).

*Primary Examiner* — George Nguyen
(74) *Attorney, Agent, or Firm* — Ballard Spahr LLP

(57) ABSTRACT

The invention relates to a device for sanding a predetermined impression into a workpiece. The device has a pattern belt positioned inside the area formed by a sanding belt. A pad is positioned inside the area formed by the pattern belt. A raised pattern is formed on the outer surface of the pattern belt. In use, the pad contacts the pattern belt, urging the raised pattern of the pattern belt to contact the sanding belt. The portion of the sanding belt contacted by the pattern belt is urged toward the workpiece so that the predetermined impression is sanded into the workpiece.

43 Claims, 8 Drawing Sheets

(56) References Cited

U.S. PATENT DOCUMENTS

| | | | | |
|---|---|---|---|---|
| 5,020,282 | A * | 6/1991 | Okajima et al. | 451/541 |
| 5,193,314 | A * | 3/1993 | Wormley et al. | 451/5 |
| 5,220,750 | A * | 6/1993 | Emberland et al. | 451/303 |
| 6,102,781 | A * | 8/2000 | Greathouse et al. | 451/59 |
| 6,135,859 | A * | 10/2000 | Tietz | 451/41 |
| 6,283,836 | B1 * | 9/2001 | Fruitman et al. | 451/56 |
| 6,302,767 | B1 * | 10/2001 | Tietz | 451/41 |
| 6,769,958 | B1 * | 8/2004 | Grivna | 451/5 |
| 6,913,512 | B2 * | 7/2005 | Grivna | 451/5 |
| 6,949,006 | B1 * | 9/2005 | Chen et al. | 451/5 |
| 7,052,380 | B2 * | 5/2006 | Weber | 451/303 |
| 8,330,452 | B2 * | 12/2012 | Furukawa | 324/207.11 |
| 2003/0066574 | A1 | 4/2003 | Lovchik et al. | |
| 2004/0235391 | A1 * | 11/2004 | Grivna | 451/5 |
| 2008/0133051 | A1 * | 6/2008 | Wallace et al. | 700/230 |
| 2009/0178902 | A1 * | 7/2009 | Lynn et al. | 198/810.02 |
| 2009/0266684 | A1 * | 10/2009 | Nishikita | 198/810.02 |

* cited by examiner

PATTERN SANDER DEVICE, SYSTEM AND METHOD

This application claims priority to and the benefit of U.S. Provisional Application No. 61/488,436, filed on May 20, 2011, which is incorporated in its entirety in this document by reference.

FIELD OF THE INVENTION

This invention relates to a sander for sanding an object. More specifically, this invention relates to a device for sanding a predetermined impression into a workpiece.

BACKGROUND OF THE INVENTION

Distressed wood flooring is typically comprised of a plurality of planks distressed to make the planks look and feel as if the planks are aged planks. To give the planks a unique look and finish, the planks can be hand distressed or machine distressed. However, hand distressing a plank can be a time-consuming, labor-intensive job in which a skilled craftsman uses a variety of tools to individually distress each plank. Thus, because of the amount of time and skill required to distress a plank by hand, hand-distressed planks can be prohibitively expensive.

Machines can be used to sand and/or scrape planks to try and replicate a hand-distressed look without requiring a skilled craftsman and to more quickly distress the planks. However, with conventional distressing machines, repetitive markings can be formed that can detract from the aesthetic value of the planks when installed as part of a flooring system.

Thus, there is a need in the pertinent art for methods, systems and devices for machine-distressing planks without creating repetitive markings. The present invention fulfills these needs and provides further related advantages as described herein.

SUMMARY

The invention relates to methods and devices for sanding a predetermined impression into a workpiece. In one aspect, the device for sanding a predetermined impression into a workpiece can be configured to sand a pattern formed on a pattern belt into an upper surface of the workpiece.

In one aspect, the device for sanding a predetermined impression can comprise a sanding belt, a pattern belt, and a pad. As the sanding belt and the pattern belt rotate about a plurality of rollers, the pad can be lowered to a position closer to the workpiece so that a force is exerted on a portion of the pattern belt, which exerts a force on a portion the sanding belt. This portion of the pattern belt exerts a force onto a portion of the sanding belt so that the sanding belt sands the predetermined impression into the workpiece.

In one aspect, the pattern belt can have a predetermined raised pattern formed on an outer surface of the pattern belt. In another aspect, the raised pattern can be formed in a shape so that the predetermined impression can be formed in the workpiece. For example, a plurality of raised ridges can be positioned on the outer surface of the pattern belt so that a simulated distressed appearance is sanded into a plurality of planks. It is contemplated that the raised pattern can be formed from any number of shapes, such as substantially rectangular, substantially square, substantially oval, substantially linear, arcuate and the like.

In one aspect, the pad can comprise a plurality of individual pad fingers. Each pad finger of the plurality of individual pad fingers can be individually controlled so that the pad fingers can simultaneously exert varying amounts of force through the pattern belt and to the sanding belt.

In one aspect, the device for sanding a predetermined impression can further comprise a control system configured to control at least one the speed of a feed belt on which the workpiece travels, the speed of the sanding belt, the speed of the pattern belt, and the pressure exerted by the pad. In another aspect, the control system can be an automatic control system configured to automatically adjust at least one of the feed belt speed, the sanding belt speed, the pattern belt speed and the position of the pad so that the device sands the predetermined impression into the workpiece.

In order to use the device, in one aspect, the feed belt speed, the sanding belt speed and the pattern belt speed can be set to desired speeds. The pad can be positioned in a desired position so that the pad exerts a desired pressure on the pattern belt, urging the pattern belt toward the sanding belt. At least a portion of the pattern belt, such as the raised pattern, can contact the sanding belt, and at least the portion of the sanding belt contacted by the pattern belt can be urged toward and contact the workpiece. The portion of the sanding belt contacting the workpiece can sand the predetermined impression into the workpiece.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
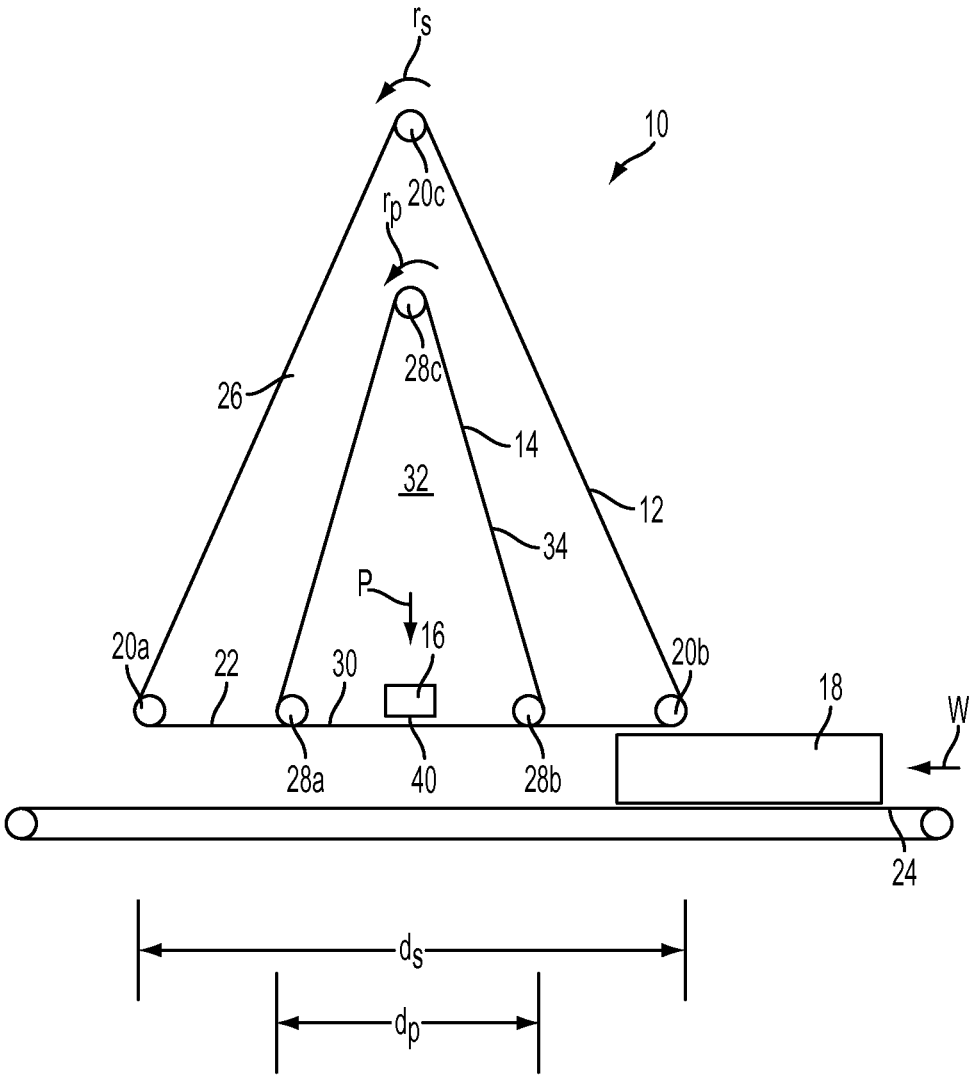
FIG. 1 is a side elevational view of a device for sanding a predetermined impression into a workpiece according to one aspect, showing a pad of the device in a raised position.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a panel" can include two or more such panels unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the terms "workpiece" refers to any object capable of being abraded. The workpiece can be substantially flat, such as a flooring plank, a wall panel, a door, any other sheet material and the like. Alternatively, at least a portion of the workpiece can be curved. The workpiece can be formed from wood, metal, or polymeric materials such as, for example and without limitation, rigid foam. For convenience and ease of reading, the term "flooring panel" or "flooring plank" will be used herein, though reference can be to a workpiece having any other use (such as a wall panel, a door and the like).

The application relates to methods and devices for sanding a predetermined impression into a workpiece. In one aspect, as illustrated in FIG. 1, the device 10 for sanding a predetermined impression can comprise a sanding belt 12, a pattern belt 14, and a pad 16. As will be described more fully below, as the sanding belt and the pattern belt rotate about a plurality of rollers, the pad can be configured for exerting a force on a portion the pattern belt 14, which exerts a force on a portion the sanding belt 12 so that the sanding belt sands the predetermined impression into the workpiece.

In one aspect, the sanding belt 12 can be an endless sanding belt trained around a plurality of sanding belt rollers 20. At least one of the sanding belt rollers can be selectively driven by a motor or drive, which causes the sanding belt to rotate about the sanding belt rollers 20 at a sanding belt speed and in a sanding belt rotation direction $r_S$. As known to one of skill in the art, at least a portion of the surface of the sanding belt can have a grit of a predetermined value to sand or otherwise abrade the workpiece 18 to a desired smoothness. In another aspect, at least a portion 22 of the sanding belt 12 can be substantially parallel to a feed belt 24 on which the workpiece 18 travels. For example and still with reference to FIG. 1, the lower portion 22 of the sanding belt can be trained around lower sanding belt rollers 20*a*, 20*b* so that the lower portion of the sanding belt is substantially parallel to the feed belt 24 for a sanding distance $d_S$. As can be appreciated, because the sanding belt 12 is an endless belt, a sanding belt area 26 can be enclosed by the sanding belt.

The pattern belt 14 can be an endless pattern belt positioned within the sanding belt area 26, according to one aspect. In another aspect, the pattern belt can be trained around a plurality of pattern belt rollers 28. At least one of the pattern belt rollers can be selectively driven by a motor or drive, which causes the pattern belt to rotate about the pattern belt rollers at a pattern belt speed and in a pattern belt rotation direction $r_P$. In another aspect, at least a portion 30 of the pattern belt 14 can be substantially parallel to the sanding belt 12 and/or the feed belt 24. With reference again to FIG. 1, the lower portion 30 of the pattern belt can be trained around lower pattern belt rollers 28*a*, 28*b* so that the lower portion of the pattern belt is substantially parallel to the sanding belt for a pattern distance $d_P$. Because the pattern belt 14 is enclosed within the sanding belt area 26, the pattern distance $d_P$ can be less than the sanding distance $d_S$. As can be appreciated, because the pattern belt 14 is an endless belt, a pattern belt area 32 can be enclosed by the pattern belt.

Figure 4:
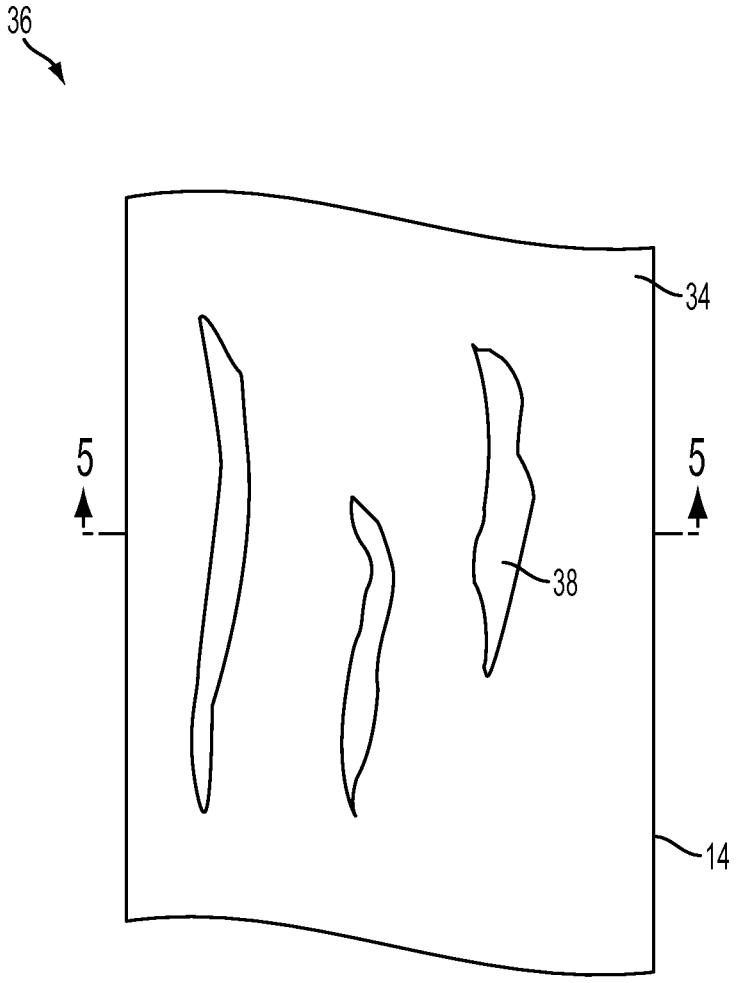
FIG. 4 is a partial top-plan view of a pattern belt of the device of FIG. 1, according to one aspect.
Figure 5:
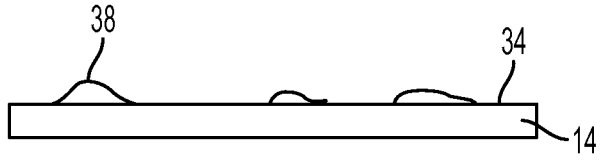
FIG. 5 is a cross-sectional view of the pattern belt of FIG. 4 taken along line 5-5.

In one aspect, the pattern belt 14 can have a predetermined raised pattern 36 positioned and/or formed on at least a portion of an outer surface 34 of the pattern belt. For example and as illustrated in FIGS. 4 and 5, a plurality of raised ridges 38 can be positioned on the outer surface of the pattern belt. It is contemplated that the raised pattern can be any number of shapes, such as substantially rectangular, substantially square, substantially oval, substantially linear, arcuate and the like. In other aspects, it is contemplated that the raised pattern 36 can be any shape as required to sand a desired impression into the workpiece 18, described more fully below. With reference to FIG. 5, when viewed in cross-section, the raised pattern 36 of the pattern belt can comprise a plurality of shapes. In one aspect, at least one cross-sectional shape of the raised pattern can be substantially parabolic. In another aspect, at least one cross-sectional shape of the raised pattern 36 can form a portion of a square, rectangle, trapezoid, circle, or any other shape. For example, the cross-sectional shape of the raised pattern can form a portion of a square so that as the raised pattern 36 abrades during use, the area of the raised pattern does not change.

In one aspect, the predetermined raised pattern 36 can be formed from a material having a relatively low coefficient of friction, such as, for example and without limitation, graphite. In this aspect, an adhesive can be used to adhere the material to the outer surface 34 of the pattern belt 14 as required in order to form the predetermined raised pattern 36. In another aspect, the raised pattern can have a height measured from the outer surface 34 of the pattern belt 14 of about 0.01 inches, 0.02 inches, 0.03 inches, 0.04 inches, 0.05 inches, 0.06 inches, 0.07 inches, 0.08 inches, 0.09 inches, 0.10 inches 0.11 inches, 0.12 inches, 0.13 inches, 0.14 inches, 0.15 inches, 0.16 inches, 0.17 inches, 0.18 inches, 0.19 inches, 0.20 inches, and greater than about 0.20 inches. In another aspect, each portion of the raised pattern can have substantially the same height. Alternatively, a first portion of the raised pattern can have a first pattern height, and a second portion of the raised pattern can have a second pattern height. It is contemplated each portion of the raised pattern can have a different height. For example, a first raised ridge of the plurality of raised ridges 38 can have a first ridge height, a second raised ridge of the plurality of raised ridges can have a second ridge height, and so on. It is also contemplated that a variety of pattern belts can be provided so that a user of the device 10 can quickly change pattern belts and the impression sanded into the workpiece.

In order to form the predetermined raised pattern 36 on the pattern belt 14, in one aspect, a desired pattern can be formed into a stencil or template. The stencil can be selectively positioned on at least a portion of the pattern belt, and an adhesive can be applied through at least one opening in the stencil to the pattern belt. A material having a relatively low coefficient of friction, such as, for example and without limitation, graphite, can then be poured over or otherwise applied to the adhesive forming a raised pattern. Alternatively, in another aspect, the adhesive can be applied to the pattern belt 14 without the use of a stencil or template (i.e., freehanded), and graphite can then be applied to the adhesive forming a raised pattern. The steps of applying adhesive to the pattern belt 14 and applying graphite to the adhesive can be repeated as necessary to build up the height of the raised pattern to the desired pattern height.

It is also contemplated that, in one aspect, the predetermined raised pattern 36 of the pattern belt 14 can be formed by building up alternating layers of adhesive and graphite to a desired pattern height. In this aspect, upon reaching the desired pattern height, a CNC or other milling device can remove selected portions of the graphite and/or the adhesive so that the raised pattern is formed from the remaining graphite and/or adhesive on the pattern belt.

Figure 2:
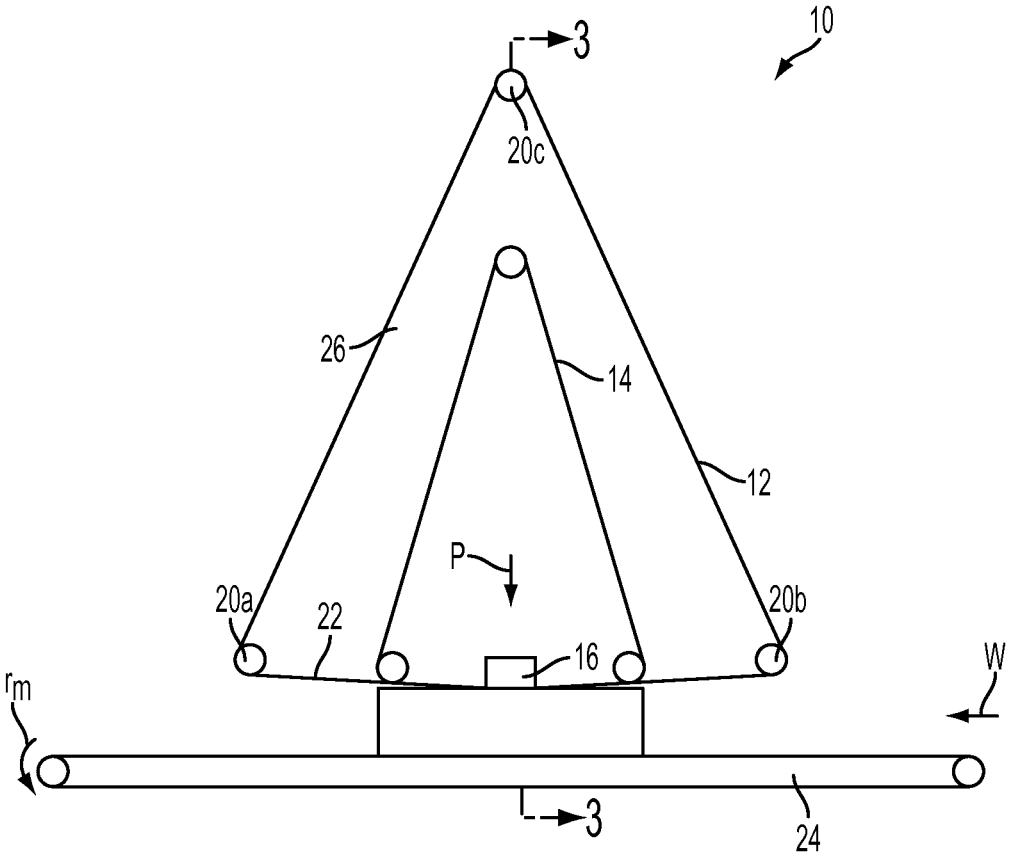
FIG. 2 is a side elevational view of the device of FIG. 1, showing the pad of the device in a lowered position.

The pad 16 can be configured to exert a force on a portion of the sanding belt 12 and the pattern belt 14 into the workpiece 18. In one aspect, the pad can be positioned in the pattern belt area 32. In another aspect, the pad can be coupled to a device capable of selectively raising and lowering the pad about and between a raised position, in which the pad is a first distance away from the pattern belt 14, and a lowered position, in which the pad 16 is a second distance away from the pattern belt that is less than the first distance. In still another aspect, as the pad is moved to a lowered position, (the lowered position is illustrated in FIG. 2), a force can be exerted on the pattern belt, the sanding belt, and the workpiece. Conventional devices that are capable of selectively raising and lowering the pad 16 can be, for example and without limitation, a pneumatic device, a hydraulic device, an electric motor, and the like.

In one aspect, the pad can have a sanding surface 40 that can be substantially parallel to the feed belt 24 on which the workpiece 18 travels. In a further aspect, it is contemplated that the sanding surface of the respective pad can be substantially planar or otherwise be positioned substantially parallel to the machine direction or the surface of the feed belt 24. Optionally, it is contemplated that the sanding surface of the pad can have a cross-sectional shape, with respect to the machine direction, such that the whole of the lower surface of the pad is not substantially planar so that application of pressure via the pad can be focused as desired. Thus, in this aspect, it is contemplated that at least a portion of the cross-sectional shape of the sanding surface of the pad can comprise at least one arcuate surface, at least one planar surface positioned in parallel or non-parallel relationship to the machine direction, and/or other geometric shapes as desired. For example, and without limitation, the cross-sectional shape of the sanding surface of the pad can have a "V" shape, a convex shape, and the like. Optionally, in other aspects, portions of the sanding surface can be concave or convex, as desired, in order to sand a desired impression into the workpiece.

Figure 3:
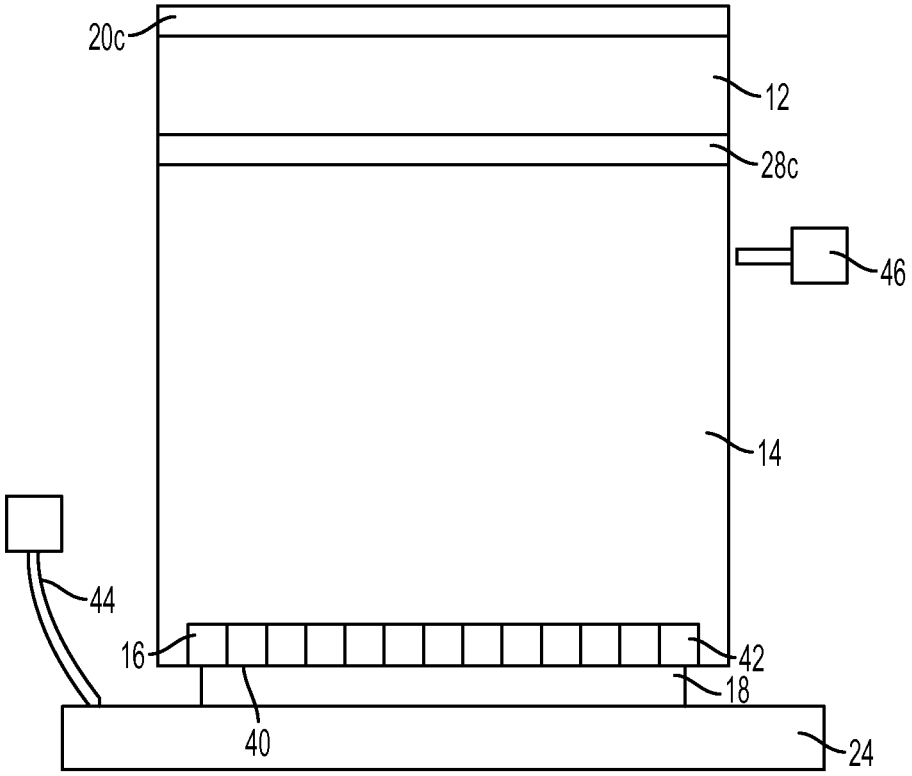
FIG. 3 is a cross-sectional view of the device of FIG. 2 taken along line 3-3.

In one aspect and as illustrated in FIG. 3, the pad can comprise a plurality of individual pad fingers 42. In this aspect, each pad finger of the plurality of pad fingers can be individually controlled so that the respective pad fingers 42 can simultaneously selectively exert varying or the same amounts of force onto the pattern belt 14.

In a further aspect, the pad 16 can have a pad width that extends in the machine direction (i.e., from left to right in FIG. 1). In one aspect, a smaller pad width can cause a more defined pattern to be formed in the workpiece 18. In another aspect, a larger pad width can more aggressively and more quickly abrade the workpiece because the sanding surface 40 of the pad is larger. That is, the width of the pad can be selected by a user of the device to balance a desired pattern transference level versus the amount of time that is required to abrade the workpiece to a desired level. In one aspect, the pad 16 can have a pad width between about ¼ inch and 8 inches. In another aspect, the pad can have a pad width between about ½ inch and 6 inches. In yet another aspect, the pad can have a pad width between about 1 inch and 4 inches.

In another aspect, in operation, the pad 16 can be selectively replaced as desired to effect a desired application of pressure on the underlying pattern and sanding belts. For example, a pad 16 having a larger pad width could be replaced with a pad having a smaller pad width to allow for the production of patterned pieces with enhanced detailing.

Figure 6:
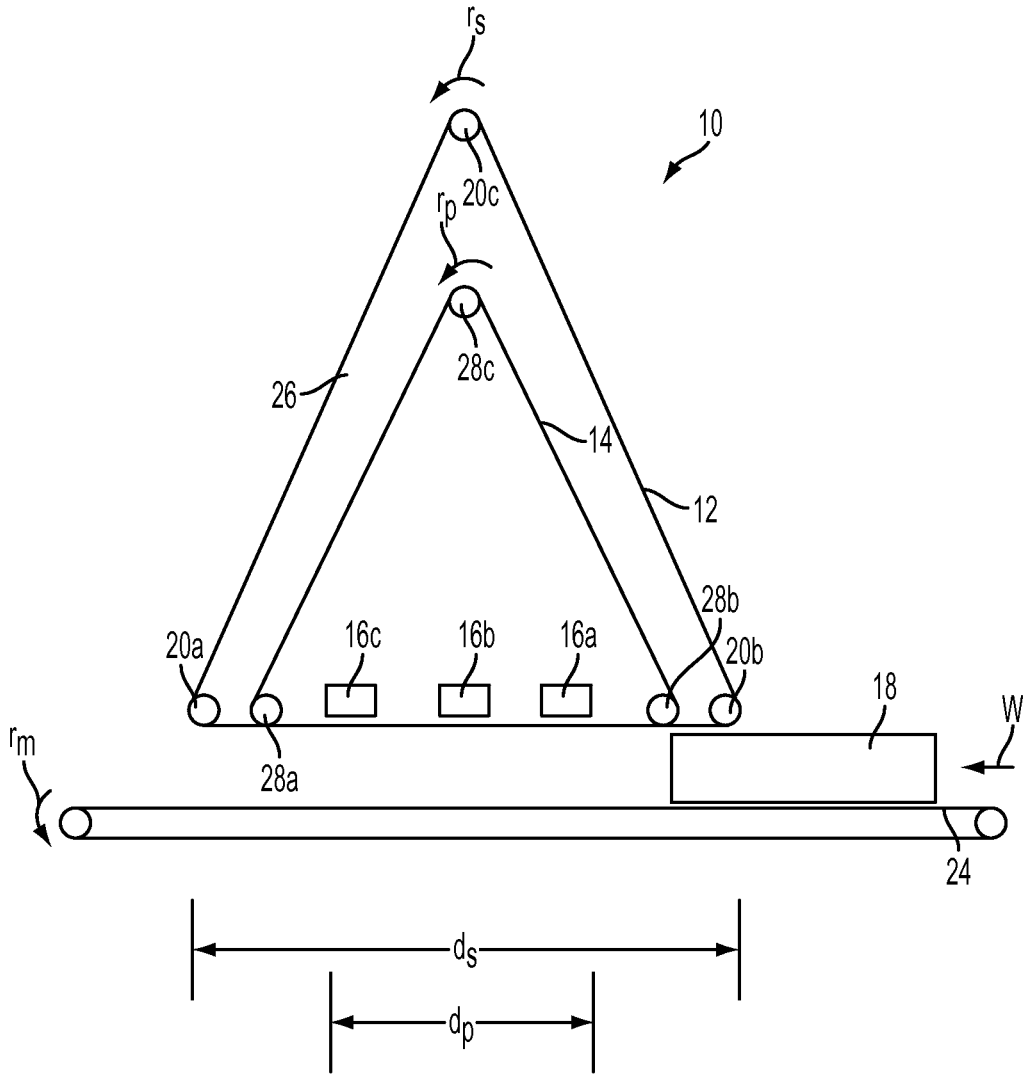
FIG. 6 is a side elevational view of a device for sanding a predetermined impression into a workpiece according to one aspect, showing a plurality of pads of the device.

Optionally, and with reference to FIG. 6, in one aspect, the pad 16 can comprise a plurality of pads 16*a*, 16*b*, 16*c*. (Although FIG. 6 illustrates three pads, it is contemplated that any number of pads can be provided). In this aspect, each pad of the plurality of pads can be selectively raised and lowered about and between the raised position and the lowered position regardless of the position of the other pads. Thus, for example and without limitation, a first pad 16*a* can be in the raised position, a second pad 16*b* can be in the lowered position, and a third pad can be positioned between the raised and lowered position. As can be appreciated, changing the position of at least one pad of the plurality of pads can alter the image abraded into the workpiece 18. In another aspect, it is contemplated that each of the pads 16*a*, 16*b*, 16*c* can have a different pad width and/or geometric cross-section, which allows for the selective application of detail to the processed workpieces without requiring a physical change of the pad 16.

In one aspect, the distance between an outer surface of the feed belt 24 and at least one of the lower sanding belt rollers 20*a*, 20*b* and the lower pattern belt rollers 28*a*, 28*b* can be selectively adjustable. For example, the distance between at least one of the lower sanding belt rollers and the lower pattern belt rollers can be decreased if a relatively thin workpiece 18 is being fed to the device 10. In another example, the distance between at least one of the lower sanding belt rollers and the lower pattern belt rollers can be increased if a relatively thick workpiece is being fed to the device.

According to one aspect, the device 10 for sanding a predetermined impression can further comprise a vacuum system 44 configured for removing at least a portion of the material abraded from the workpiece 18. In this aspect and with reference to FIG. 3, at least a portion of the vacuum system can be adjacent the sanding belt 12. The vacuum system can operate continuously when the sanding belt is rotating, or alternatively, the vacuum system can operate for a predetermined period of time when the sanding belt is rotating. In another aspect, the device 10 for sanding a predetermined impression can further comprise at least one belt blower 46. In this aspect, at least a portion of the belt blower can be adjacent the sanding belt 12 and can be configured to blow air towards at least a portion of the sanding belt to remove at least a portion of the material abraded from the workpiece, the sanding belt and/or the pattern belt 14. The belt blower 46 can be activated continuously when the sanding belt is rotating, or alternatively, the belt blower can be activated for a predetermined period of time when the sanding belt is rotating. Alternatively, the belt blower 46 can selectively be activated when the sanding belt is not rotating.

In one aspect, the device 10 for sanding a predetermined impression can further comprise a control system. In another aspect, the control system can comprise a processor. As one having ordinary skill in the pertinent art will appreciate, the processor can be any processing element known in the art, such as, without limitation, a personal computer or a server computer. As one having ordinary skill in the pertinent art will further appreciate, the processor can comprise any of a number of processing devices, systems or the like that are capable of operating in accordance with the embodiments of the invention. It is contemplated that the processor can be in communication with a memory that stores content, data, or the like. The memory can also store software applications, instructions, or the like for the processor to perform steps associated with control of the feed belt 24, the sanding belt 12, the pattern belt 14, and the pad 16, as described herein. In one aspect, the control system can be configured to control at least one the speed of the feed belt, the speed of the sanding belt, the speed of the pattern belt, and the amount of pressure exerted by the pad.

It is further contemplated that the processor can be connected to at least one interface or other means for displaying, transmitting, and/or receiving data, content, or the like. The interface can include at least one communication interface or other means for transmitting and/or receiving data, content, or the like, as well as at least one user interface that can include a display and/or a user input interface. The user input interface, in turn, can comprise any of a number of devices allowing the processor to receive data from a user, such as a keypad, a touch display, a joystick or other input device.

Figure 7:
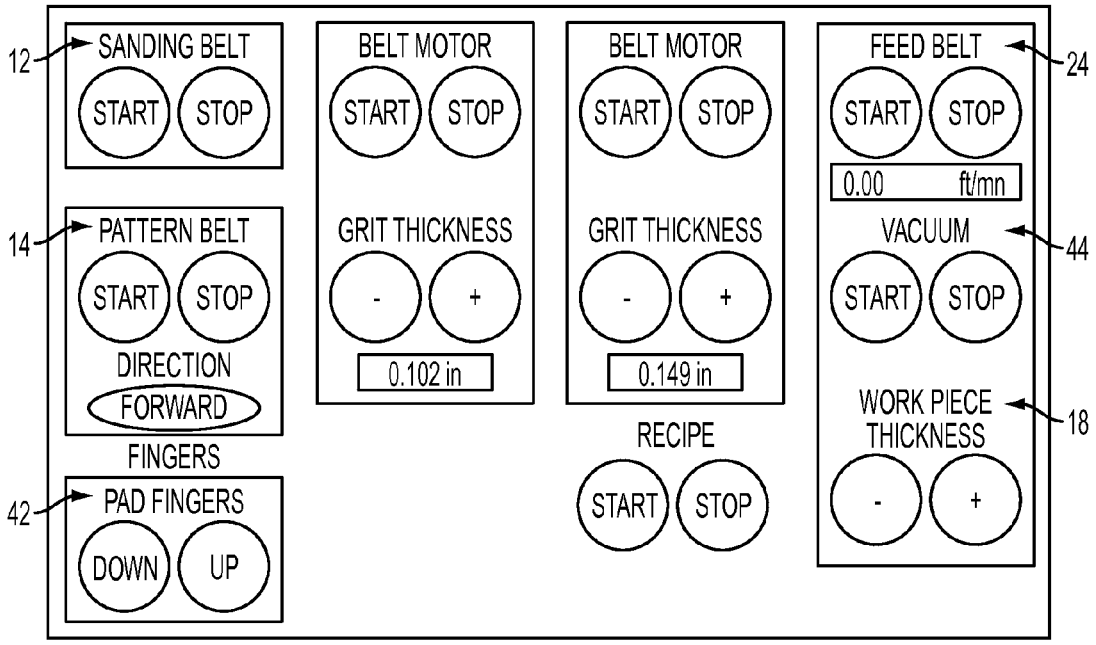
FIGS. 7-9 are exemplary views of an interface of a control system of the device of FIG. 1.
Figure 8:
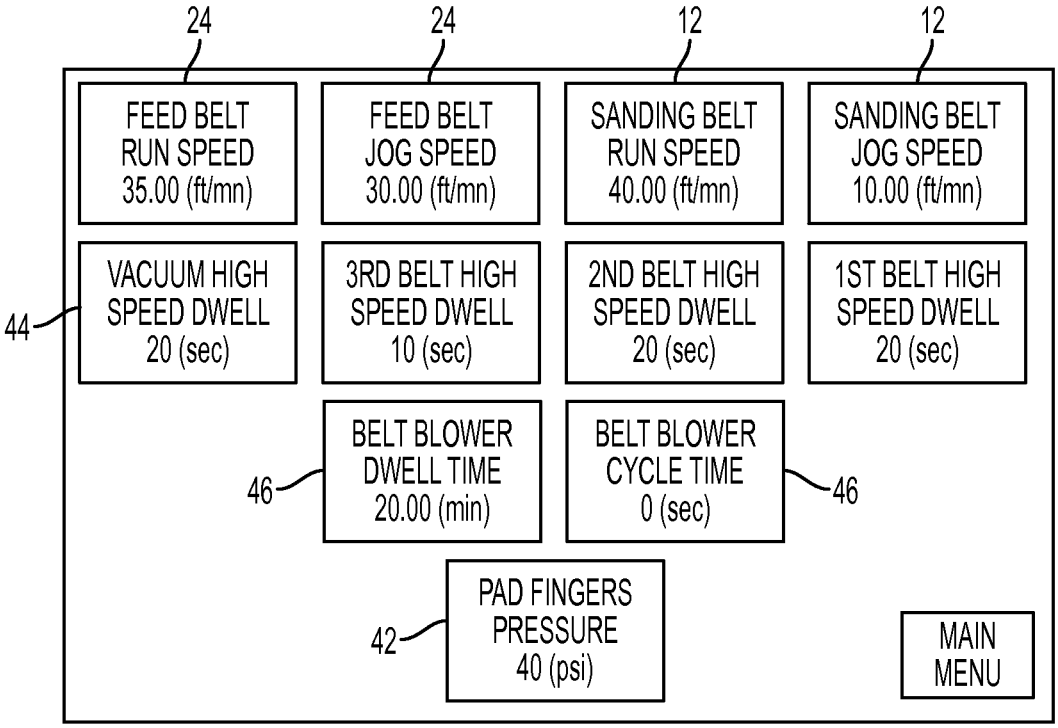
Figure 9:
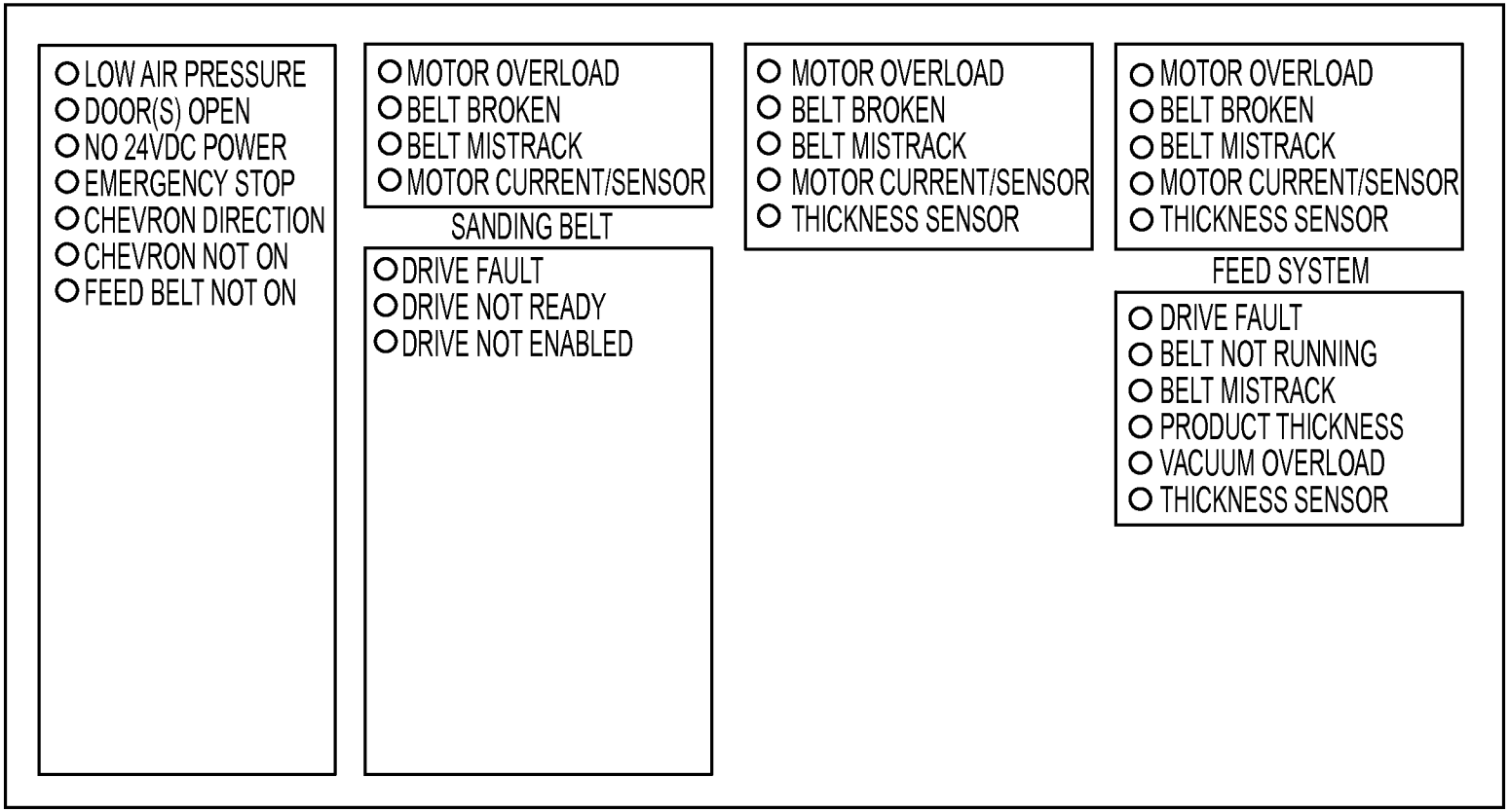

The control system can be coupled to at least one of the sanding belt 12, the pattern belt 14, the feed belt 24, and the pad 16. For example, the control system can be coupled to the driven roller of the sanding belt, the driven roller of the pattern belt, a driven roller of the feed belt, and/or the pad. FIGS. 7-9 illustrate exemplary views of the interface of the control system in which operational parameters of the device can be displayed and adjusted. In one aspect, the control system can comprise a manual adjustment system so that an operator of the device 10 can manually adjust the sanding belt speed, the pattern belt speed, the feed belt speed, the force exerted by the pad onto the workpiece 18, and the distance between the pad 16 and the feed belt. In another aspect, the control system can further comprise at least one feedback loop so that the control system can automatically control at least one of the sanding belt 12 speed, the pattern belt speed, the feed belt speed, the force exerted by the pad onto the workpiece, and the distance between the pad 16 and the feed belt 24. In this aspect, the control system can automatically adjust the force exerted by the pad and/or the speed of a belt based on, for example and without limitation, the amount of wear sustained by the pattern belt 14.

In one aspect, the processor of the control system can store a plurality of control "recipes." Each control recipe can comprise operating conditions for sanding a predetermined impression into a workpiece. For example, a control recipe can comprise the speed of the feed belt 24, the speed of the sanding belt 12, the speed of the pattern belt 14, the direction of travel of the pattern belt, and/or the pressure exerted by the pad 16 on a workpiece so that the predetermined impression is formed in the workpiece. In another aspect, the control system can store a plurality of recipes, for example and without limitation, at least 2 recipes, at least 3 recipes, at least 4 recipes, at least 5 recipes, at least 6 recipes, at least 7 recipes, at least 8 recipes, at least 9 recipes, at least 10 recipes, at least 15 recipes, at least 20 recipes, at least 25 recipes, at least 30 recipes, and the like. In still another aspect, when the pad comprises a plurality of pad fingers 42, each recipe can store a plurality of finger control steps. For example, a recipe can store the force to be exerted on the workpiece by each finger of the plurality of pad fingers. The use of the recipes allows the desired operating parameters to be entered into the processor only once for each recipe. The recipes can be recalled when desired so that the device 10 will sand the desired impression into the workpiece.

Optionally, any of the parameters of a particular control recipe can be selectively changed so that a customized impression is formed in the workpiece. For example and without limitation, changing one or more of the speed of the feed belt 24, the speed of the sanding belt 12, the speed of the pattern belt 14, the direction of travel of the pattern belt, and/or the pressure exerted by the pad 16 on a workpiece, can create a "custom" recipe that can be stored as desired.

In order to program a recipe, in one aspect, the direction in which the pattern belt 14 will travel with respect to the feed belt 24 (with the feed belt or against the feed belt) can be entered into the processor. In another aspect, a pattern belt offset speed percentage can be entered into the processor. This value represents the upper and lower limit of the pattern belt 14 with respect to the feed belt. For example, if the pattern belt offset speed percentage is 10%, then the speed of the pattern belt 14 can be within 90% and 110% of the speed of the feed belt 24. In still another aspect, an offset speed time can also be entered into the processor. The offset speed time represents the time that the pattern belt can take to traverse the speed range from the minus offset speed percentage to the plus offset speed percentage and back to the minus offset speed percentage. For example, if the offset speed time is 10 seconds, then it would take 10 seconds for the speed of the pattern belt 14 to change from 90% of the feed belt speed to 110% of the feed belt speed and back to 90% of the feed belt speed. As can be appreciated, if the operator changes the speed of the feed belt 24 while the device 10 is running, the pattern belt can automatically adjust for the change in feed belt speed.

In another aspect, pressure parameters for the pad 16 or the plurality of fingers 42 of the pad can be entered into the processor. In this aspect, the pressure parameters can comprise a pressure offset percentage and a pressure offset time. As described above with respect to the pattern belt offset speed percentage and offset speed time, the pressure offset percentage and a pressure offset time can cooperate to control the force exerted by the pad 16 or the plurality of fingers 42 of the pad. In this aspect, the pressure offset percentage can be a percentage of a standard pressure setpoint, so for example, if the pressure offset percentage is 10%, then the pressure exerted by the pad 16 or the respective pad finger 42 can be ±10% of the standard pressure setpoint.

In one aspect, each recipe can store a plurality of separate steps for controlling which fingers 42 of the plurality of fingers of the pad 16 are to exert force against the pattern belt 14 at any given time. In another aspect, each recipe can store the number of fingers to be active during any given recipe step. Along with selecting the active fingers for each step, the duration the respective fingers are active can also be programmed in each recipe step. Once a recipe step becomes active, the selected fingers are actuated for the programmed duration. When the duration is over, the control system will then run the next step in the recipe. For any step not required (i.e., if a recipe call for only twelve steps out of a possible twenty-five steps), the control system can skip to the next step until reaching the end of the recipe before starting the recipe over again with the recipe's first step.

In one aspect, it is possible to make a modification to a recipe to allow the stored values of the recipe to change with each programmed step in the recipe.

In order to use the device 10, the predetermined raised pattern 36 can be applied to and/or formed on the outer surface 34 of the pattern belt 14. For example, a material having a relatively low coefficient of friction, such as graphite, can be adhered to the pattern belt so that a raised pattern having a predetermined pattern height can be formed. In one example, a plurality of raised ridges can be formed so that a distressed look can be sanded into the workpiece 18 when the device is in use. In other examples, the raised pattern 36 can be positioned on the pattern belt so that such as number, letters and/or other shapes can be sanded into the workpiece. The pattern belt 14 can be positioned about the pattern belt rollers 28 positioned within the sanding belt area 26 so that the raised pattern is facing towards the sanding belt 12.

In one aspect, the operator of the device 10 can set the feed belt to a desired feed belt speed, the sanding belt 12 to a desired sanding belt speed and the pattern belt 14 to a desired pattern belt speed. For example, the speed of the feed belt can be set so that the workpiece is under the pad 16 for a predetermined amount of time. In another example, the speed of the sanding belt 12 can be set so that a desired amount of sanding in done to the workpiece while the workpiece is under the pad. In still another example, the speed of the pattern belt can be set so that the raised pattern 36 of the pattern belt contacts the sanding belt for a desired amount of time. In one aspect, the speed of the pattern belt 14 can be substantially the same as the speed of the sanding belt 12. In other aspects, the speed of the pattern belt can be less than or greater the speed of the sanding belt. In another aspect, the sanding belt 12 and the pattern belt can rotate in the same direction. Alternatively, the sanding belt and the pattern belt 14 can rotate in opposed directions. As can be appreciated, altering the speed and/or direction of travel of the pattern belt and/or the sanding belt 12 can alter the impression sanded into the upper surface of the workpiece 18.

In another aspect, the operator of the device 10 can set the pad 16 to a desired pressure so that a predetermined amount of force is exerted through the pattern belt 14 and the sanding belt 12 to the workpiece 18. For example, the pressure can be set higher (i.e., the pad lowered to a position closer to the workpiece when the workpiece is on the feed belt under the pad 16) to exert more force on the workpiece, thereby sanding away more of the upper surface of the workpiece 18. In another example, the pressure of the pad can be set lower (i.e., the pad lowered to a position farther from the workpiece when the workpiece is on the feed belt 24 under the pad) to exert a smaller force on the workpiece 18, thereby sanding away less of the upper surface of the workpiece. If the pad 16 comprises a plurality of pad fingers 42, the pressure of each pad finger can be set to exert a desired force to a portion of the pattern belt 14, a portion of the sanding belt 12, and a portion of the workpiece 18.

Alternatively, a desired workpiece impression can be input into the control system of the device, and the control system can automatically configure the feed belt speed, the sanding belt speed, the pattern belt speed, and/or the pad pressure so that the device can automatically sand the desired workpiece impression into the workpiece 18.

When the device 10 is setup as desired, the workpiece 18 to be sanded, such as, for example and without limitation, a flooring plank, can be placed on the feed belt 24. The feed belt can carry the workpiece under the lower portion 22 of the sanding belt at the feed belt speed. As illustrated in FIG. 2, the pad 16 can be lowered to a position such that the sanding surface 40 of the pad contacts the pattern belt 14. The pattern belt can be urged towards the sanding belt 12, and at least the raised pattern 36 of the pattern belt can contact the sanding belt, thereby causing at least a portion of the sanding belt contacted by the pattern belt 14 to be urged toward and contact the workpiece 18. In this position, the at least a portion of the sanding belt sands away portions of the upper surface of the workpiece so that the desired impression is formed in the upper surface of the workpiece.

In one example, the raised pattern 36 of the outer surface 34 of the pattern belt 14 can comprise a plurality of ridges 38, as illustrated in FIG. 4. With the pad 16 in a lowered position so that pressure is applied to the pattern belt 14, when one of the raised ridges rotates under the pad, the raised ridge of the pattern belt can contact the sanding belt 12 and urge the portion of the sanding belt that is in contact with the raised ridge 38 toward the workpiece 18. This portion of the sanding belt contacts the workpiece and the raised ridge shape can be sanded into the workpiece.

In one aspect, altering the speed of the feed belt 24, the sanding belt 12 and/or the pattern belt 14 can alter the shape sanded into the workpiece 18. In another example, using the same pattern belt 14 of the previous example, if the speed of any of the belts is changed, the shape of the impression sanded into the workpiece will change. In still another example, again with reference to the pattern belt having a plurality of raised ridges 38, the pressure exerted by the pad 16 can be varied to change the impression sanded into the workpiece. As can then be appreciated, one pattern belt can be used to create a number of different impressions in the workpiece by varying the speeds and/or direction of the sanding belt 12 and/or the pattern belt 14, and the amount of pressure exerted by the pad 16 onto the pattern belt.

In another example, if the pad 16 comprises a plurality of pad fingers 42, the pressure exerted by each pad finger can be individually controlled and varied so that the desired impression can be sanded into the workpiece. In this example, a first pad finger could be in a lowered position for a first rotation of the pattern belt 14, and a raised position for a second rotation of the pattern belt. Adjacent pad fingers could be in the same position as the first pad finger or in different positions. By varying the position and amount of time each pad finger 42 is in a lowered or raised position, any number of different impressions can be sanded into the workpiece 18.

As the device 10 is operated, the pattern belt 14 rotates about the pattern belt rollers 28. As described above, when the sanding surface 40 of the pad 16 contacts the rotating pattern belt, the pattern belt is urged toward the sanding belt 12 and at least a portion of the pattern belt 14, such as the raised pattern 36, can contact the sanding belt. As can be appreciated, the repeated contact between the raised pattern and the sanding belt can cause the pattern to become worn and can cause the shape of the raised pattern to change. In one aspect, as the raised pattern wears or abrades, the control system can adjust at least one of the speed of the feed belt 24, the speed of the sanding belt 12, the speed of the pattern belt 14 and/or the amount of pressure exerted by the pad 16 to compensate for the wearing of the raised pattern 36 so that the impression sanded into the workpiece 18 does not vary over time due to the condition of the pattern belt. In another aspect, the impression formed in the workpiece can be measured, and at least one of the speed of the feed belt 24, the speed of the sanding belt 12, the speed of the pattern belt 14 and/or the amount of pressure exerted by the pad 16 can be adjusted manually by a user of the device to compensate for the wearing of the raised pattern 36.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A device for forming a predetermined impression into a workpiece comprising:

a sanding belt having a grit configured to abrade at least a portion of the workpiece, wherein the sanding belt is an endless sanding belt selectively rotatable about a sanding belt area;

a pattern belt positioned therein the sanding area, wherein the pattern belt has a predetermined raised pattern formed on at least a portion of an outer surface of the pattern belt, and wherein the pattern belt is an endless pattern belt selectively rotatable about a pattern belt area; and a pad positioned therein the pattern belt area, wherein the pad is selectively movable about and between a raised position, in which the pad is a first distance away from the pattern belt, and a lowered position, in which the pad is a second distance away from the pattern belt that is less than the first distance, wherein in the lowered position, a sanding surface of the pad exerts a force on a portion of the pattern belt urging at least the predetermined raised pattern of the pattern belt to contact a portion of the sanding belt, wherein the portion of the sanding belt contacts the workpiece and abrades the predetermined impression therein, wherein the pad comprises a plurality of pad fingers, and wherein each pad finger is individually, selectively movable about and between the raised position and the lowered position.

2. The device for forming a predetermined impression of claim 1, further comprising a feed belt configured to position the workpiece relative to the sanding belt for a predetermined amount of time.

3. The device for forming a predetermined impression of claim 2, wherein at least a portion of the sanding belt is substantially parallel to a portion of the feed belt for a sanding distance.

4. The device for forming a predetermined impression of claim 3, wherein at least a portion of the pattern belt is substantially parallel to a portion of the feed belt for a pattern distance.

5. The device for forming a predetermined impression of claim 4, wherein the pattern distance is less than the sanding distance.

6. The device for forming a predetermined impression of claim 2, further comprising a control system comprising a processor coupled to at least one of the feed belt, the sanding belt, the pattern belt and the pad, wherein the control system is configured to control at least one of a speed of the feed belt speed, a speed of the sanding belt, a speed of the pattern belt and the pad position.

7. The device for forming a predetermined impression of claim 6, wherein the control system comprises at least one feedback loop to automatically adjust at least one of the feed belt speed, the sanding belt speed, the pattern belt speed and the pad position based on the amount of wear sustained by the pattern belt.

8. The device for forming a predetermined impression of claim 6, wherein the control system is configured to store a plurality of control recipes, and wherein each control recipe comprises operating conditions for forming the predetermined impression into the workpiece.

9. The device for forming a predetermined impression of claim 6, wherein the control system controls the rotational speed of the pattern belt relative to the feed belt.

10. The device for forming a predetermined impression of claim 9, wherein the rotational speed of the pattern belt is maintained within an offset speed percentage relative to the feed belt.

11. The device for forming a predetermined impression of claim 10, wherein the offset speed percentage of the pattern belt is 10%.

12. The device for forming a predetermined impression of claim 1, wherein the predetermined raised pattern comprises a plurality of raised ridges.

13. The device for forming a predetermined impression of claim 12, wherein the plurality of raised ridges is formed from a friction reducing substance.

14. The device for forming a predetermined impression of claim 13, wherein the friction reducing substance is graphite.

15. The device for forming a predetermined impression of claim 1, further comprising a means for maintaining a substantially constant area of the predetermined raised pattern as the predetermined raised pattern abrades during use.

16. The device for forming a predetermined impression of claim 1, wherein the pattern belt is selectively rotated in the same direction as the sanding belt.

17. A device for forming a predetermined impression into a workpiece comprising:

a sanding belt having a grit configured to abrade at least a portion of the workpiece, wherein the sanding belt is an endless sanding belt selectively rotatable about a sanding belt area;

a pattern belt positioned therein the sanding area, wherein the pattern belt has a predetermined raised pattern formed on at least a portion of an outer surface of the pattern belt, and wherein the pattern belt is an endless pattern belt selectively rotatable about a pattern belt area; and a pad positioned therein the pattern belt area, wherein the pad is selectively movable about and between a raised position, in which the pad is a first distance away from the pattern belt, and a lowered position, in which the pad is a second distance away from the pattern belt that is less than the first distance, wherein in the lowered position, a sanding surface of the pad exerts a force on a portion of the pattern belt urging at least the predetermined raised pattern of the pattern belt to contact a portion of the sanding belt, and wherein the portion of the sanding belt contacts the workpiece and abrades the predetermined impression therein;

a feed belt configured to position the workpiece relative to the sanding belt for a predetermined amount of time; and a control system comprising a processor coupled to at least one of the feed belt, the sanding belt, the pattern belt and the pad, wherein the control system is configured to control at least one of a speed of the feed belt speed, a speed of the sanding belt, a speed of the pattern belt and the pad position, and wherein the control system comprises at least one feedback loop to automatically adjust at least one of the feed belt speed, the sanding belt speed, the pattern belt speed and the pad position based on the amount of wear sustained by the pattern belt.

18. The device for forming a predetermined impression of claim 17, wherein at least a portion of the sanding belt is substantially parallel to a portion of the feed belt for a sanding distance.

19. The device for forming a predetermined impression of claim 18, wherein at least a portion of the pattern belt is substantially parallel to a portion of the feed belt for a pattern distance.

20. The device for forming a predetermined impression of claim 19, wherein the pattern distance is less than the sanding distance.

21. The device for forming a predetermined impression of claim 17, wherein the control system is configured to store a plurality of control recipes, and wherein each control recipe comprises operating conditions for forming the predetermined impression into the workpiece.

22. The device for forming a predetermined impression of claim 17, wherein the control system controls the rotational speed of the pattern belt relative to the feed belt.

23. The device for forming a predetermined impression of claim 22, wherein the rotational speed of the pattern belt is maintained within an offset speed percentage relative to the feed belt.

24. The device for forming a predetermined impression of claim 17, wherein the pad comprises a plurality of pad fingers, and wherein each pad finger is individually, selectively movable about and between the raised position and the lowered position.

25. The device for forming a predetermined impression of claim 17, wherein the pattern belt is selectively rotated in the same direction as the sanding belt.

26. A device for forming a predetermined impression into a workpiece comprising:

a sanding belt having a grit configured to abrade at least a portion of the workpiece, wherein the sanding belt is an endless sanding belt selectively rotatable about a sanding belt area;

a pattern belt positioned therein the sanding area, wherein the pattern belt has a predetermined raised pattern formed on at least a portion of an outer surface of the pattern belt, and wherein the pattern belt is an endless pattern belt selectively rotatable about a pattern belt area; and a pad positioned therein the pattern belt area, wherein the pad is selectively movable about and between a raised position, in which the pad is a first distance away from the pattern belt, and a lowered position, in which the pad is a second distance away from the pattern belt that is less than the first distance, wherein in the lowered position, a sanding surface of the pad exerts a force on a portion of the pattern belt urging at least the predetermined raised pattern of the pattern belt to contact a portion of the sanding belt, and wherein the portion of the sanding belt contacts the workpiece and abrades the predetermined impression therein;

a feed belt configured to position the workpiece relative to the sanding belt for a predetermined amount of time; and a control system comprising a processor coupled to at least one of the feed belt, the sanding belt, the pattern belt and the pad, wherein the control system is configured to control at least one of a speed of the feed belt speed, a speed of the sanding belt, a speed of the pattern belt and the pad position, wherein the control system is configured to store a plurality of control recipes, and wherein each control recipe comprises operating conditions for forming the predetermined impression into the workpiece.

27. The device for forming a predetermined impression of claim 26, wherein at least a portion of the sanding belt is substantially parallel to a portion of the feed belt for a sanding distance.

28. The device for forming a predetermined impression of claim 27, wherein at least a portion of the pattern belt is substantially parallel to a portion of the feed belt for a pattern distance.

29. The device for forming a predetermined impression of claim 28, wherein the pattern distance is less than the sanding distance.

30. The device for forming a predetermined impression of claim 26, wherein the control system comprises at least one feedback loop to automatically adjust at least one of the feed belt speed, the sanding belt speed, the pattern belt speed and the pad position based on the amount of wear sustained by the pattern belt.

31. The device for forming a predetermined impression of claim 26, wherein the control system controls the rotational speed of the pattern belt relative to the feed belt.

32. The device for forming a predetermined impression of claim 31, wherein the rotational speed of the pattern belt is maintained within an offset speed percentage relative to the feed belt.

33. The device for forming a predetermined impression of claim 26, wherein the pad comprises a plurality of pad fingers, and wherein each pad finger is individually, selectively movable about and between the raised position and the lowered position.

34. The device for forming a predetermined impression of claim 26, wherein the pattern belt is selectively rotated in the same direction as the sanding belt.

35. A device for forming a predetermined impression into a workpiece comprising:

a sanding belt having a grit configured to abrade at least a portion of the workpiece, wherein the sanding belt is an endless sanding belt selectively rotatable about a sanding belt area;

a pattern belt positioned therein the sanding area, wherein the pattern belt has a predetermined raised pattern formed on at least a portion of an outer surface of the pattern belt, and wherein the pattern belt is an endless pattern belt selectively rotatable about a pattern belt area; and a pad positioned therein the pattern belt area, wherein the pad is selectively movable about and between a raised position, in which the pad is a first distance away from the pattern belt, and a lowered position, in which the pad is a second distance away from the pattern belt that is less than the first distance, wherein in the lowered position, a sanding surface of the pad exerts a force on a portion of the pattern belt urging at least the predetermined raised pattern of the pattern belt to contact a portion of the sanding belt, and wherein the portion of the sanding belt contacts the workpiece and abrades the predetermined impression therein;

a feed belt configured to position the workpiece relative to the sanding belt for a predetermined amount of time; and a control system comprising a processor coupled to at least one of the feed belt, the sanding belt, the pattern belt and the pad, wherein the control system is configured to control at least one of a speed of the feed belt speed, a speed of the sanding belt, a speed of the pattern belt and the pad position, and wherein the control system controls the rotational speed of the pattern belt relative to the feed belt.

36. The device for forming a predetermined impression of claim 35, wherein at least a portion of the sanding belt is substantially parallel to a portion of the feed belt for a sanding distance.

37. The device for forming a predetermined impression of claim 36, wherein at least a portion of the pattern belt is substantially parallel to a portion of the feed belt for a pattern distance.

38. The device for forming a predetermined impression of claim 37, wherein the pattern distance is less than the sanding distance.

39. The device for forming a predetermined impression of claim 35, wherein the control system comprises at least one feedback loop to automatically adjust at least one of the feed belt speed, the sanding belt speed, the pattern belt speed and the pad position based on the amount of wear sustained by the pattern belt.

40. The device for forming a predetermined impression of claim 35, wherein the control system is configured to store a plurality of control recipes, and wherein each control recipe comprises operating conditions for forming the predetermined impression into the workpiece.

41. The device for forming a predetermined impression of claim 35, wherein the rotational speed of the pattern belt is maintained within an offset speed percentage relative to the feed belt.

42. The device for forming a predetermined impression of claim 35, wherein the pad comprises a plurality of pad fingers, and wherein each pad finger is individually, selectively movable about and between the raised position and the lowered position.

43. The device for forming a predetermined impression of claim 35, wherein the pattern belt is selectively rotated in the same direction as the sanding belt.

* * * * *